US010953900B2

(12) United States Patent
Kawauchi et al.

(10) Patent No.: US 10,953,900 B2
(45) **Date of Patent: *Mar. 23, 2021**

(54) ABNORMALITY DETECTION DEVICE, ABNORMALITY DETECTION METHOD, AND PROGRAM

(71) Applicant: MITSUBISHI HEAVY INDUSTRIES, LTD., Tokyo (JP)

(72) Inventors: Akihisa Kawauchi, Tokyo (JP); Hiroyuki Kono, Tokyo (JP); Koji Uchida, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 97 days.

This patent is subject to a terminal disclaimer.

(21) Appl. No.: 16/173,538

(22) Filed: Oct. 29, 2018

(65) Prior Publication Data

US 2019/0126959 A1 May 2, 2019

(30) Foreign Application Priority Data

Oct. 31, 2017 (JP) ..... JP2017-210884

(51) Int. Cl.
*B61L 25/02* (2006.01)
*B61L 23/04* (2006.01)
*B61L 1/20* (2006.01)

(52) U.S. Cl.
CPC ..... *B61L 25/021* (2013.01); *B61L 23/042* (2013.01); *B61L 25/025* (2013.01); *B61L 1/20* (2013.01)

(58) Field of Classification Search
CPC ..... B61L 25/021; B61L 25/025; B61L 1/20; B61L 23/042

(Continued)

(56) References Cited

U.S. PATENT DOCUMENTS 9,841,286 B1 * 12/2017 Hayward ..... G07C 5/008
2007/0203621 A1 * 8/2007 Haugen ..... B61K 9/08 701/19

(Continued)

FOREIGN PATENT DOCUMENTS

EP 2436574 A1 4/2012
JP 2004-108988 A 4/2004

(Continued)

OTHER PUBLICATIONS

PCT/ISA/210, "International Search Report for International Application No. PCT/JP2018/005577," dated Apr. 24, 2018.

(Continued)

*Primary Examiner* — Atul Trivedi
(74) *Attorney, Agent, or Firm* — Manabu Kanesaka; Benjamin Hauptman; Kenneth Berner

(57) ABSTRACT

An abnormality detection device includes: a measurement value acquiring unit configured to acquire input accelerations of n vehicles traveling along a track; and an abnormality determination unit configured to determine abnormality in the track at a track position at which the input accelerations are equal to or more than a threshold value in a case where it has detected that the input accelerations for all of the n vehicles are equal to or more than a threshold value, and determine abnormality in any one or a plurality of vehicles out of n−1 or less vehicles in the n vehicles at which the input accelerations are equal to or more than the threshold value in a case where it has detected that the input accelerations for the any one or a plurality of vehicles out of the n−1 or less vehicles in the n vehicles are equal to or more than the threshold value.

8 Claims, 6 Drawing Sheets

(58) Field of Classification Search
USPC ..... 701/19
See application file for complete search history.

(56) References Cited

U.S. PATENT DOCUMENTS

| | | | | |
|---|---|---|---|---|
| 2008/0234964 | A1 | 9/2008 | Miyasaka et al. | |
| 2010/0185414 | A1* | 7/2010 | Yamamoto | G05B 23/021 702/183 |
| 2012/0197476 | A1* | 8/2012 | Smith | B60T 8/885 701/24 |
| 2013/0173208 | A1* | 7/2013 | Kuzunishi | G06F 19/00 702/141 |
| 2013/0342362 | A1* | 12/2013 | Martin | B60T 13/665 340/870.16 |
| 2015/0009331 | A1* | 1/2015 | Venkatraman | B61L 23/041 348/148 |
| 2015/0051792 | A1 | 2/2015 | Kristen et al. | |
| 2016/0152255 | A1* | 6/2016 | Cuthbertson | B61L 15/0027 701/19 |
| 2017/0021847 | A1* | 1/2017 | LeFebvre | B61L 27/0077 |
| 2017/0066459 | A1* | 3/2017 | Singh | B61L 23/045 |
| 2017/0106884 | A1* | 4/2017 | Oswald | B61L 3/008 |
| 2017/0199101 | A1* | 7/2017 | Franchitti | B61L 15/0081 |
| 2017/0203745 | A1* | 7/2017 | Kumar | B61L 15/0072 |
| 2017/0210401 | A1* | 7/2017 | Mian | B61L 15/0081 |
| 2017/0253258 | A1* | 9/2017 | Bramucci | B61L 27/0005 |
| 2017/0305396 | A1* | 10/2017 | Shiratsuchi | B61L 25/026 |
| 2017/0313332 | A1* | 11/2017 | Paget | H04N 5/23203 |
| 2019/0086364 | A1* | 3/2019 | Hay | B61L 23/044 |
| 2019/0248392 | A1* | 8/2019 | Bar-Tal | B61L 15/02 |
| 2019/0391049 | A1* | 12/2019 | Jones | G01M 5/0058 |
| 2020/0023871 | A1* | 1/2020 | Snyder | B61L 25/025 |
| 2020/0191913 | A1* | 6/2020 | Zhang | G01S 13/89 |

FOREIGN PATENT DOCUMENTS

| | | | |
|---|---|---|---|
| JP | 2006-105956 | A | 4/2006 |
| JP | 2006-160153 | A | 6/2006 |
| JP | 2006-327551 | A | 12/2006 |
| JP | 2007-256153 | A | 10/2007 |
| JP | 2007-278894 | A | 10/2007 |
| JP | 2008-100669 | A | 5/2008 |
| JP | 2008-108250 | A | 5/2008 |
| JP | 2012-78213 | A | 4/2012 |
| JP | 2012-086671 | A | 5/2012 |
| JP | 2012-100434 | A | 5/2012 |
| JP | 5432818 | B2 | 3/2014 |
| JP | 5525404 | B2 | 6/2014 |
| JP | 2015-042106 | A | 3/2015 |
| JP | 5691319 | B2 | 4/2015 |
| JP | 2017-026421 | A | 2/2017 |

OTHER PUBLICATIONS

PCT/ISA/237, "Written Opinion for International Application No. PCT/JP2018/005577," dated Apr. 24, 2018.

* cited by examiner

ABNORMALITY DETECTION DEVICE, ABNORMALITY DETECTION METHOD, AND PROGRAM

BACKGROUND OF THE INVENTION

Field of the Invention

The present invention relates to an abnormality detection device, an abnormality detection method, and a program.

Priority is claimed on Japanese Patent Application No. 2017-210884, filed Oct. 31, 2017, the content of which is incorporated herein by reference.

Description of Related Art

A technology for detecting abnormality occurring in a vehicle traveling along a track or in the track is known. For example, Japanese Patent Publication No. 5691319 discloses a technology for determining the presence or absence of abnormality based on an acceleration of a vehicle. Furthermore. Japanese Unexamined Patent Application, First Publication No. 2006-160153 and Japanese Unexamined Patent Application, First Publication No. 2008-108250 disclose technologies for filter-processing an acceleration of a vehicle and determining abnormality in the vehicle by a Mahalanobis-Taguchi (MT) method.

SUMMARY OF THE INVENTION

However, in the aforementioned technologies, it is not possible to determine a vehicle or a track in which abnormality has occurred.

In light of the foregoing, an object of the present invention is to provide an abnormality detection device, an abnormality detection method, and a program that solve the aforementioned problem.

According to a first aspect of the present invention, an abnormality detection device includes: a measurement value acquiring unit configured to acquire input accelerations of n vehicles traveling along a track, wherein n represents a number of two or more; and an abnormality determination unit configured to determine abnormality in the track at a track position at which the input accelerations are equal to or more than a threshold value in a case where the abnormality determination unit has detected that the input accelerations for all of the n vehicles are equal to or more than a threshold value, the abnormality determination unit being configured to determine abnormality in any one or a plurality of vehicles out of n−1 or less vehicles in the n vehicles at which the input accelerations are equal to or more than the threshold value in a case where the abnormality determination unit has detected that the input accelerations for the any one or a plurality of vehicles out of the n−1 or less vehicles in the n vehicles are equal to or more than the threshold value.

In the above abnormality detection device, the measurement value acquiring unit may be configured to acquire a correspondence relation between the input accelerations and a position of the track, and the abnormality determination unit may be configured to inversely estimate a vertical displacement amount of the track based on the input accelerations and a model formula of the vehicle and specify a vertical displacement amount equal to or more than a predetermined threshold value and a position of the track at which the specified vertical displacement amount has been generated in a case where the abnormality determination unit has detected that the input accelerations for all of the n vehicles are equal to or more than the threshold value, the model formula including a relation between at least a vertical displacement amount of the track and a slate amount of the constituent member of the vehicle and an acceleration of the vehicle.

In the above abnormality detection device, the measurement value acquiring unit may be configured to acquire a correspondence relation between the input accelerations and a position of the track, and the abnormality determination unit may be configured to inversely estimate a state amount of a constituent member of the vehicle based on the input accelerations and a model formula of the vehicle and specify, as an abnormal place, the constituent member which indicates the state amount equal to or more than a predetermined threshold value in a case where the abnormality determination unit has detected that the input accelerations for the any one or a plurality of vehicles out of the n−1 or less vehicles in the n vehicles are equal to or more than the threshold value, the model formula including a relation between at least a vertical displacement amount of the track and the state amount of the constituent member of the vehicle and an acceleration of the vehicle.

In the above abnormality detection device, the abnormality determination unit may be configured to inversely estimate a state amount of a constituent member of the vehicle based on the input accelerations and a model formula of the vehicle and specify, as an abnormal place, the constituent member which indicates the state amount equal to or more than a predetermined threshold value in a case where the abnormality determination unit has not detected that the input accelerations for one or more vehicles are equal to or more than the threshold value, the model formula including a relation between at least a vertical displacement amount of the track and the state amount of the constituent member of the vehicle and an acceleration of the vehicle.

According to a second aspect of the present invention, an abnormality detection method includes: acquiring input accelerations of n vehicles traveling along a track, wherein n represents a number of two or more; determining abnormality in the track at a track position at which the input accelerations are equal to or more than a threshold value in a case where it has been detected that the input accelerations for all of the n vehicles are equal to or more than a threshold value; and determining abnormality in any one or a plurality of vehicles out of n−1 or less vehicles in the n vehicles at which the input accelerations are equal to or more than the threshold value in a case where it has been detected that the input accelerations for the any one or a plurality of vehicles out of the n−1 or less vehicles in the n vehicles.

According to a third aspect of the present invention, a non-transitory computer-readable recording medium stores a program for causing a computer of an abnormality detection device to function as: a measurement value acquiring unit configured to acquire input accelerations of n vehicles traveling along a track, wherein n represents a number of two or more; and an abnormality determination unit configured to determine abnormality in the track at a track position at which the input accelerations are equal to or more than a threshold value in a case where the abnormality determination unit has detected that the input accelerations for all of the n vehicles are equal to or more than a threshold value, the abnormality determination unit being configured to determine abnormality in any one or a plurality of vehicles out of n−1 or less vehicles in the n vehicles at which the input accelerations are equal to or more than the threshold value in a case where the abnormality determination unit has detected that the input accelerations for the any one or a plurality of vehicles out of the n−1 or less vehicles in the n vehicles are equal to or more than the threshold value.

DETAILED DESCRIPTION OF THE INVENTION

Figure 1:
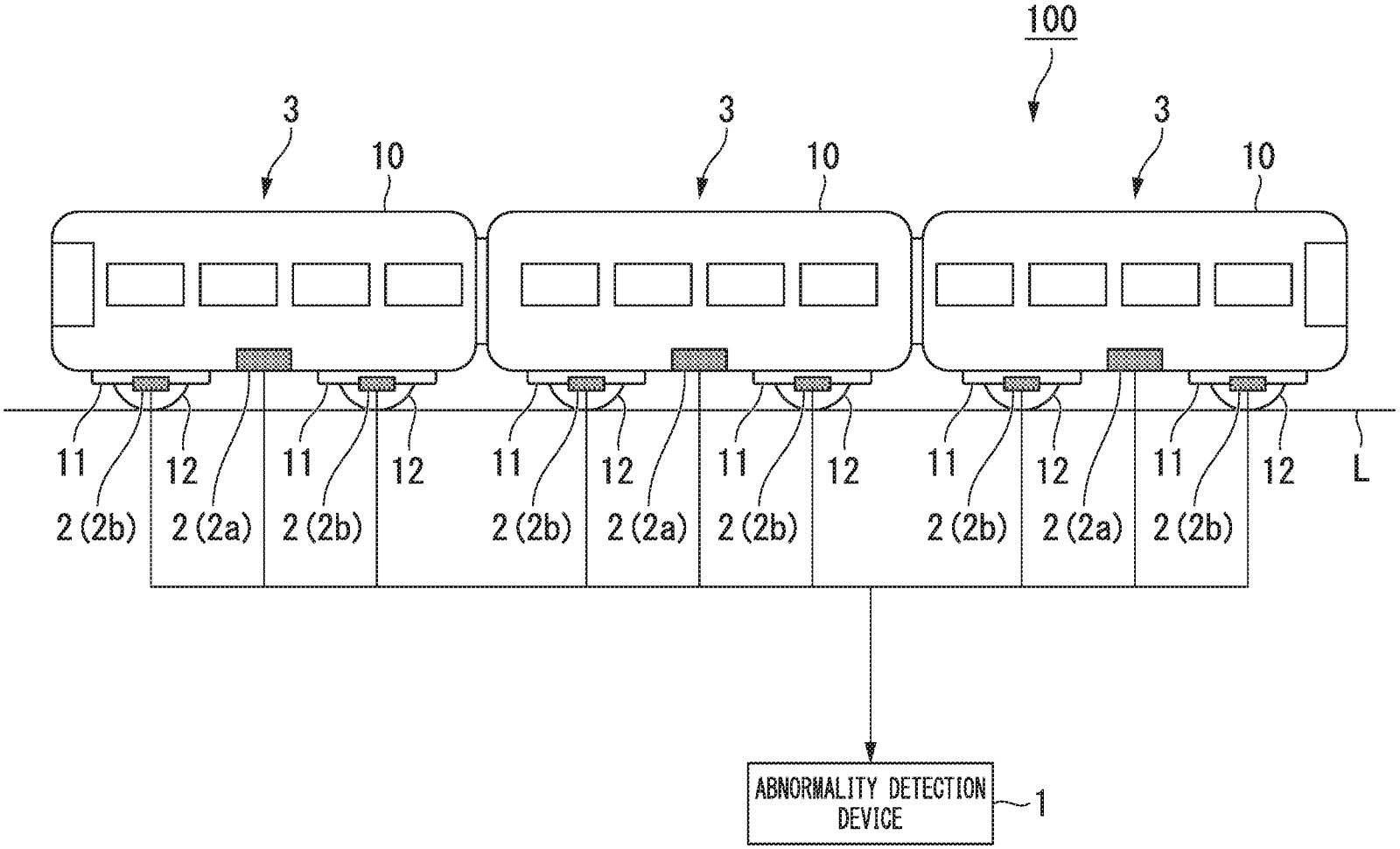
FIG. 1 is a diagram showing a configuration of an abnormality sensing system including an abnormality detection device.

Hereinafter, an abnormality detection device according to an embodiment of the present invention will be described with reference to the drawings. FIG. 1 is a diagram showing a configuration of an abnormality sensing system including an abnormality detection device according to the embodiment.

As shown in FIG. 1, an abnormality sensing system 100 is composed of an abnormality detection device 1 and acceleration sensors 2*a* and 2*b* communicatively connected to the abnormality detection device 1. The acceleration sensor 2*a* is provided on a vehicle body 10. The acceleration sensor 2*b* is provided on a bogie 11. Although abnormality detection device 1 is shown outside a train in FIG. 1, the abnormality detection device 1 may also be provided in the train. When the abnormality detection device 1 is provided outside the train, the abnormality detection device 1 may be provided in a control room and the like for example. When the abnormality detection device 1 is provided outside the train, the train may have a transmission function of transmitting measured values obtained from the acceleration sensors 2*a* and 2*b* to the abnormality detection device 1. When the acceleration sensor 2*a* and the acceleration sensor 2*b* are generically referred to, they are referred to as acceleration sensors 2. The train may be obtained by connecting a plurality of vehicles 3 including the vehicle body 10, the bogie 11, a tire 12 and the like to one another. FIG. 1 shows a state in which the train including three connected vehicles 3 travels along a track L.

Figure 2:
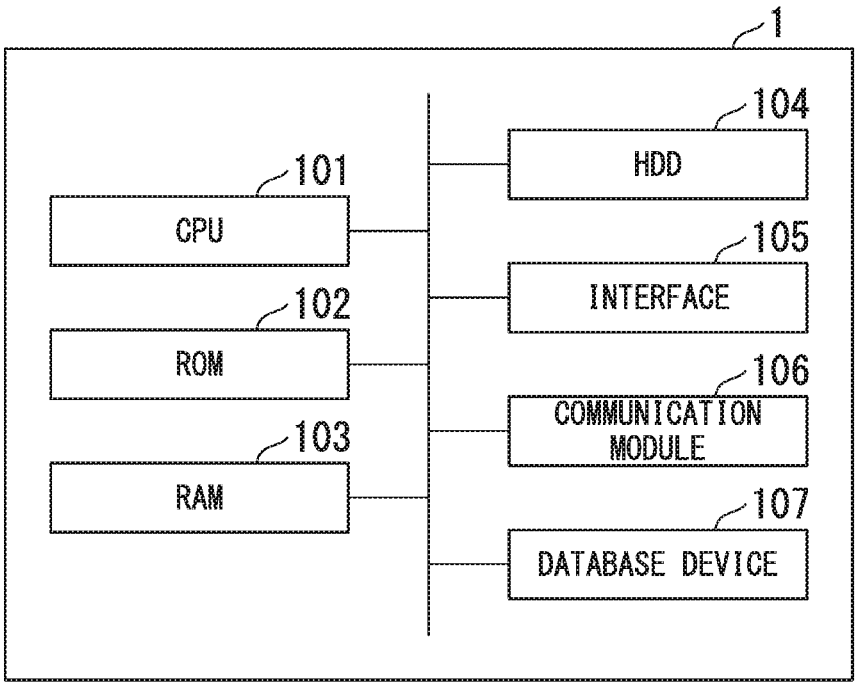
FIG. 2 is a diagram showing a hardware configuration of the abnormality detection device.

FIG. 2 is a diagram showing a hardware configuration of the abnormality detection device according to the present embodiment.

As shown in FIG. 2, the abnormality detection device 1 is a computer, and may be configured by hardware including a CPU 101, a storage unit such as a read only memory (ROM) 102, a random access memory (RAM) 103, and a hard disk drive (HDD) 104, a user interface 105, a communication module 106, a database device 107 and the like.

Figure 3:
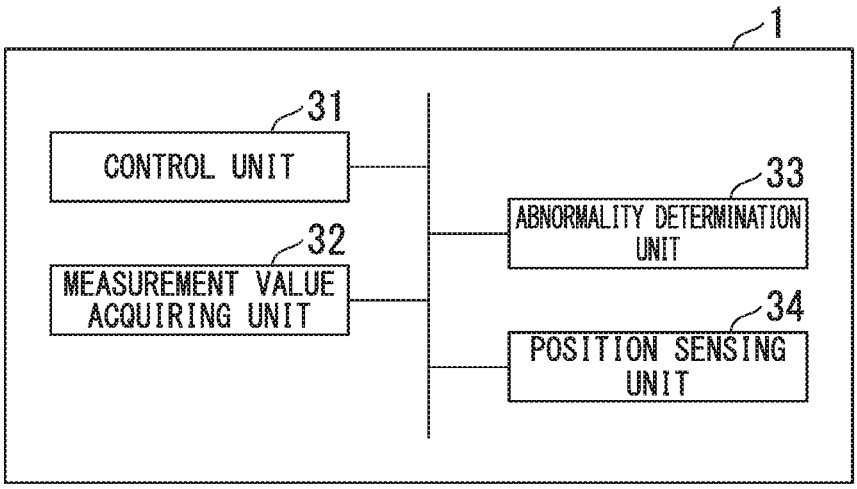
FIG. 3 is a functional block diagram of the abnormality detection device.

FIG. 3 is a functional block diagram of the abnormality detection device according to the present embodiment.

The CPU 101 of the abnormality detection device 1 executes a stored abnormality sensing program on the basis of a user operation. Accordingly, the abnormality detection device 1 has each function of a control unit 31, a measurement value acquiring unit 32, an abnormality determination unit 33, and a position sensing unit 34.

The control unit 31 controls other functions.

The measurement value acquiring unit 32 acquires input accelerations of a plurality of (n) vehicles 3 traveling along a track. In the present embodiment, the measurement value acquiring unit 32 acquires accelerations from the acceleration sensors 2*a* and 2*b* of each of the three vehicles 3 constituting the train.

When input accelerations equal to or more than a threshold value are detected for all of the plurality of (n) vehicles 3, the abnormality determination unit 33 determines abnormality in a track position at which the input accelerations are equal to or more than the threshold value. Furthermore, when the input accelerations equal to or more than the threshold value are detected for any one or a plurality of vehicles 3 equal to or less than (n−1) of the plurality of (n) vehicles 3, the abnormality determination unit 33 determines abnormality in a vehicle 3 at which the input acceleration is equal to or more than the threshold value.

The position sensing unit 34 acquires a signal transmitted from an on-ground unit or a GPS satellite, and senses the position of the train on the basis of information included in the signal.

Figure 4:
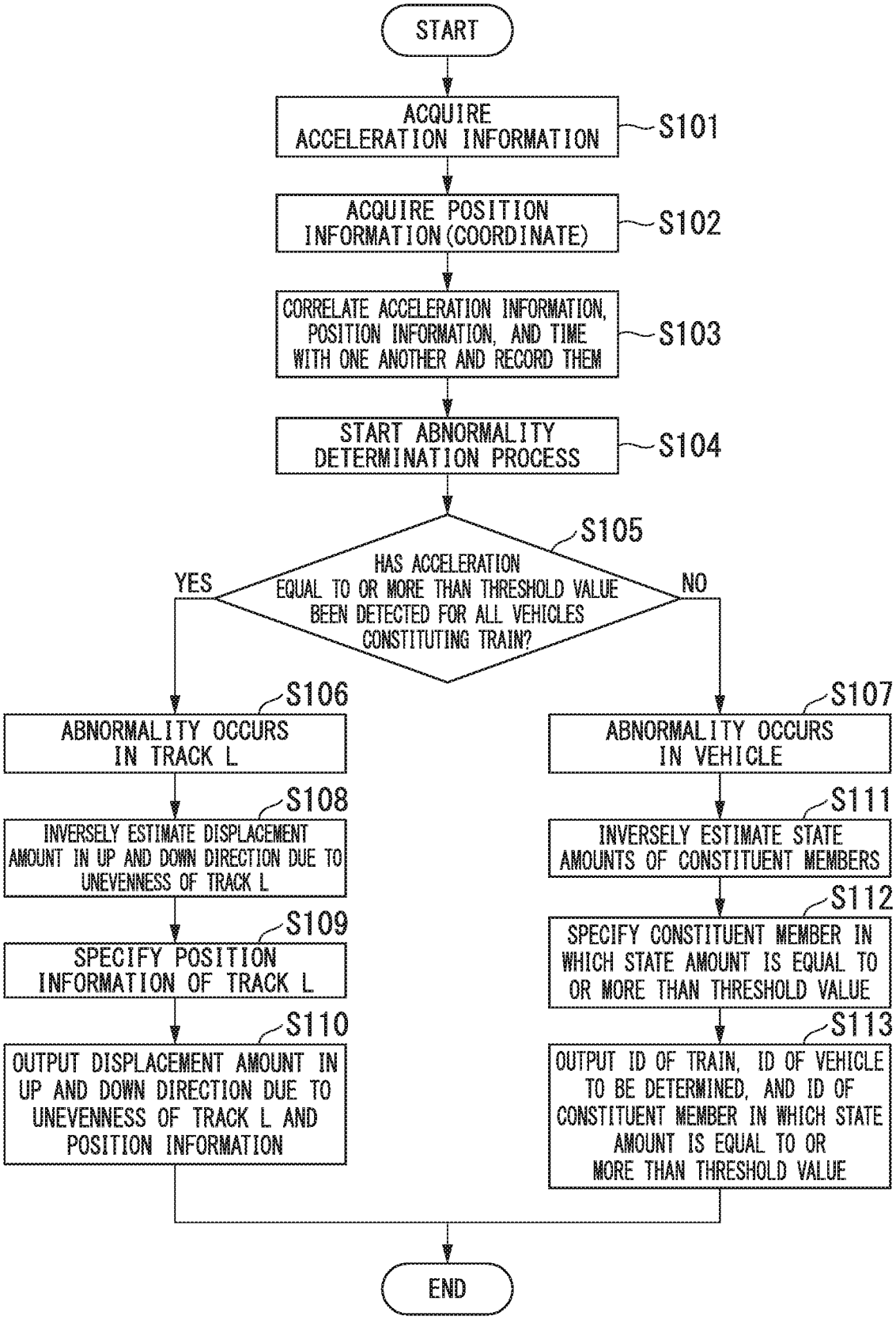
FIG. 4 is a diagram showing a processing flow of the abnormality detection device.

FIG. 4 is a diagram showing a processing flow of the abnormality detection device.

While the train is travelling, the measurement value acquiring unit 32 of the abnormality detection device 1 acquires acceleration information, which includes IDs of the acceleration sensors 2, IDs of the vehicles 3 provided with the acceleration sensors 2, and an ID of the train configured by the vehicles 3, from the acceleration sensors 2 (step S101). Furthermore, the measurement value acquiring unit 32 acquires position information (coordinates) from the position sensing unit 34 (step S102). The measurement value acquiring unit 32 correlates the IDs of the acceleration sensors 2, the acquired acceleration information, the position information, and a time with one another, and records the correlated results in an acceleration table of the database device 107 (step S103).

Accordingly, the time, the acceleration of the acceleration sensor 2*a*, the acceleration of the acceleration sensor 2*b*, and positions, each sensor ID, the vehicle IDs, and the train ID, which have been acquired from the position sensing unit 34 at the acquisition timings of these accelerations, are recorded in the acceleration table of the database device 107 in association with one another. The abnormality determination unit 33 reads information recorded in the database device 107 at a predetermined timing and starts an abnormality determination process (step S104). The predetermined timing, at which the abnormality determination process is started, for example, may be immediately after the train have traveled a start point to an end point of the track L or a timing provided for each predetermined period such as one week and one month. In the abnormality detection device 1, train information obtained by associating the train ID with the vehicle IDs constituting the train is recorded in a train management table of the database device 107.

The abnormality determination unit 33 specifies a vehicle ID and a train ID associated with an acceleration equal to or more than a threshold value. The threshold value of the acceleration is a lower limit threshold value of an acceleration for determining that there is abnormality in the track L or one or a plurality of constituent members of the vehicles 3. The abnormality determination unit 33 acquires IDs of all vehicles constituting the train from the train management table by using the train ID from the specified vehicle ID and train ID. The abnormality determination unit 33 determines whether the acceleration equal to or more than the threshold value has been detected for all the vehicle IDs acquired from the train management table (step S105). When the acceleration equal to or more than the threshold value is detected for all the vehicle IDs, the abnormality determination unit 33 determining that there is abnormality in the track L (step S106). Furthermore, when the acceleration equal to or more than the threshold value has been detected for vehicle IDs of one or a plurality of vehicles 3 equal to or less than (n−1) vehicles among vehicle IDs corresponding to n vehicles constituting the train, the abnormality determination unit 33 determines that there is an abnormality in the one or plurality of vehicles 3 (step S107).

When it is determined that there is abnormality in the track L, the abnormality determination unit 33 puts the acceleration equal to or more than the threshold value into a model formula of the vehicle 3 including a relation between at least a displacement amount in an up and down direction due to unevenness of the track L and state amounts and accelerations of one or a plurality of constituent members of the vehicle 3, thereby inversely estimating the displacement amount in the up and down direction due to the unevenness of the track L (step S108). Furthermore, the abnormality determination unit 33 specifies position information of the track L for which the acceleration equal to or more than the threshold value has been detected (step S109). The abnormality determination unit 33 outputs the calculated displacement amount in the up and down direction due to the unevenness of the track L and the position information (step S110). Accordingly, on the basis of the displacement amount in the up and down direction and the position information, a manager specifies the state and the position of the track L and performs inspection, repair and the like.

When it is determined that there is abnormality in the vehicle 3, the abnormality determination unit 33 puts the acceleration equal to or more than the threshold value, which has been obtained from the acceleration sensors 2 of the vehicle 3, into the model formula, thereby inversely estimating the state amounts of the one or plurality of constituent members of the vehicle 3 (step S111). The abnormality determination unit 33 specifies a constituent member in which the state amount is equal to or more than the threshold value (step S112). The abnormality determination unit 33 outputs an ID of a vehicle 3 in which the state amount of the constituent member is equal to or more than the threshold value, an ID of the train to which the vehicle 3 is connected, an ID of a vehicle to be specified, and an ID of the constituent member in which the state amount is equal to or more than the threshold value (step S113). Accordingly, on the basis of the train ID, the vehicle ID, and the constituent member ID, a manager specifies a constituent member of a vehicle 3 of a train in which abnormality has occurred, and performs inspection, repair and the like.

Figure 5:
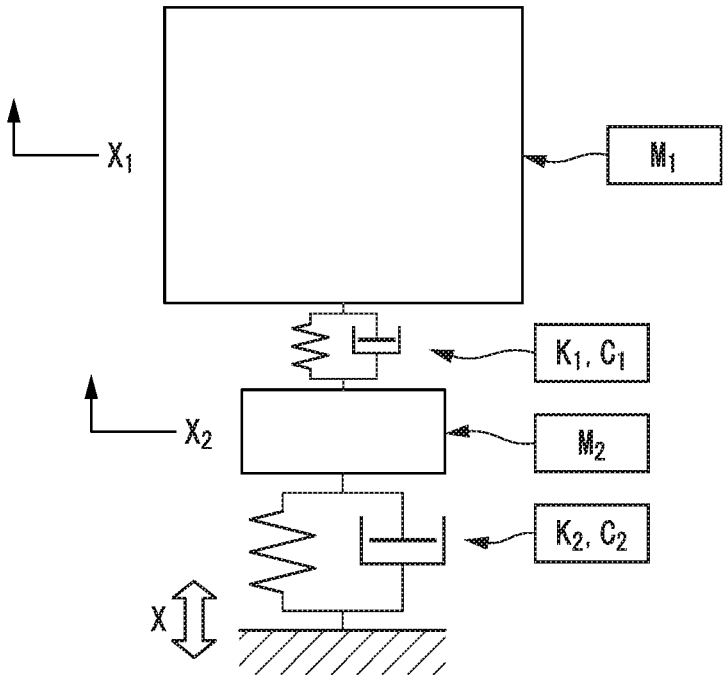
FIG. 5 is a diagram showing a first example of a vehicle model.

FIG. 5 is a diagram showing a first example of a vehicle model.

As shown in FIG. 5, when it is assumed that a displacement amount in an up and down direction of the track L is X, a displacement amount of the vehicle body 10 is X1, a mass of the vehicle body 10 is M1, a mass of the bogie 11 is M2, a displacement amount of the bogie 11 is X2, a spring constant of a spring component constituting a buffer device (a damper or an air spring) provided between the vehicle body 10 and the bogie 11 is K1, an attenuation coefficient of a damper component constituting the buffer device is C1, a spring constant of a spring component of a tire is K2, and an attenuation coefficient of a damper component of the tire is C2, the vehicle model can be expressed by a model formula (1) below.

In the model formula (1), a right side indicates a force applied to the tire. A dash and a double dash added onto signs of the model formula (1) indicate a differentiation and a second-order differentiation, respectively. In the model formula (1), a value indicated by a second-order differentiation of the displacement amount X1 is an acceleration measured by the acceleration sensor 2*a*. Furthermore, in the model formula (1), a value (an acceleration) indicated by a second-order differentiation of the displacement amount X2 is an acceleration measured by the acceleration sensor 2*b*. In addition, differential values (speeds) of the displacement amounts X1 and X2 can be calculated by integration of the accelerations, and the displacement amounts X1 and X2 can be calculated by integrating the differential values (speeds) of the displacement amounts X1 and X2.

$$\begin{bmatrix} M_1 & 0 \\ 0 & M_2 \end{bmatrix}\begin{bmatrix} X_1'' \\ X_2'' \end{bmatrix} + \begin{bmatrix} C_1 & -C_1 \\ -C_1 & C_1 + C_2 \end{bmatrix}\begin{bmatrix} X_1' \\ X_2' \end{bmatrix} + \begin{bmatrix} K_1 & -K_1 \\ -K_1 & K_1 + K_2 \end{bmatrix}\begin{bmatrix} X_1 \\ X_2 \end{bmatrix} = \begin{bmatrix} 0 \\ C_2X' + K_2X \end{bmatrix} \tag{1}$$

The abnormality determination unit 33 puts the masses M1 and M2, the measured accelerations X1" and X2", the calculated speeds X1' and X2', the calculated displacement amounts X1 and X2, the spring constants K1 and K2 in a normal case, the attenuation coefficients C1 and C2 in the normal case, and the like into the model formula (1), thereby performing inverse estimation for calculating a displacement amount in an up and down direction of the tire 12, a spring constant, and an attenuation coefficient by an optimization calculation when simultaneous equations are satisfied. When it is determined that there is abnormality in the track L, the abnormality determination unit 33 specifies and outputs the displacement amount X in the up and down direction of the tire 12 in the up and down direction as a result of the inverse estimation. Furthermore, when it is determined that there is abnormality in a vehicle, the abnormality determination unit 33 specifies a tire corresponding to a spring constant and an attenuation coefficient which are values deviating from the spring constants K1 and K2 or the attenuation coefficients C1 and C2 in the normal case, and a constituent member such as a buffer device as abnormal places as a result of the inverse estimation.

Figure 6:
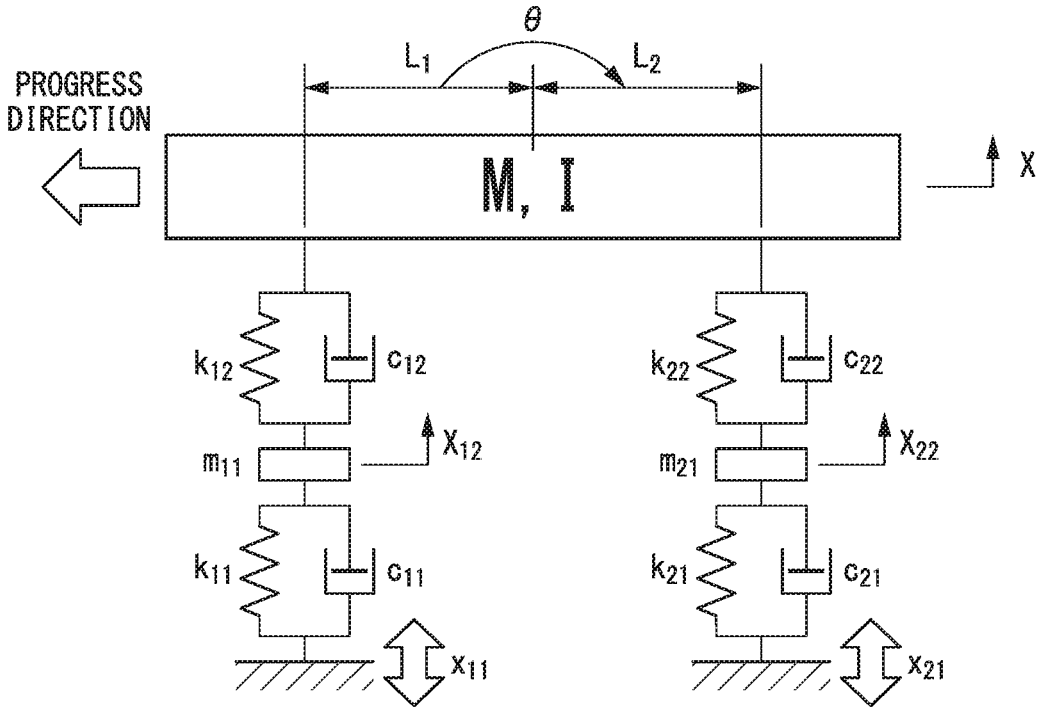
FIG. 6 is a diagram showing a second example of the vehicle model.

FIG. 6 is a diagram showing a second example of the vehicle model.

The abnormality determination unit 33 may use a model formula (2) below instead of the model formula (1). The explanation of a model formula shown in FIG. 6 is an example when force applied to the bogies 11 and the tires 12 respectively provided at the front side and the rear side of the vehicle body 10 is expressed by separate model formulas. It is assumed that a distance from a center position before and after the vehicle 3 to a center position of a front bogie is L1, a distance from the center position before and after the vehicle 3 to a center position of a rear bogie is L2, and an inclination in a front and rear direction with respect to the center position before and after the vehicle 3 is θ. Furthermore, it is assumed that the displacement of the vehicle body 10 is X, the mass of the vehicle body 10 is M, the inertia moment of the vehicle body 10 is I, the mass of a front bogie 11 is m11, a spring constant of a spring component constituting a buffer device (a damper or an air spring) provided between a front vehicle body 10 and the bogie 11 is K12, an attenuation coefficient of a damper component is C12, a spring constant of a tire is K11, an attenuation coefficient of the tire is C11, and a displacement amount (an unevenness amount of a track) in an up and down direction of a front tire 12 is x11. Furthermore, it is assumed that the mass of a rear bogie 11 is m21, a spring constant of a spring component constituting a buffer device (a damper or an air spring) provided between a rear vehicle body 10 and the bogie 11 is K22, an attenuation coefficient of a damper component is C22, a spring constant of a rear tire is K21, an attenuation coefficient of the tire is C21, and a displacement amount (an unevenness amount of a track) in an up and down direction of a rear tire 12 is x21. In such a case, the model formula can be expressed by a model formula (2) shown in FIG. 6.

$$\begin{bmatrix} M & 0 & 0 & 0 \\ 0 & I & 0 & 0 \\ 0 & 0 & m_{11} & 0 \\ 0 & 0 & 0 & m_{21} \end{bmatrix} \begin{bmatrix} X'' \\ \theta'' \\ x''_{12} \\ x''_{22} \end{bmatrix} + \begin{bmatrix} c_{12}+c_{22} & -c_{12}L_1+c_{22}L_2 & -c_{12} & -c_{22} \\ -c_{12}L_1+c_{22}L_2 & c_{12}L_1^2+c_{22}L_2^2 & c_{12}L_1 & -c_{22}L_2 \\ -c_{12} & c_{12}L_1 & c_{12}+c_{11} & 0 \\ -c_{22} & -c_{22}L_2 & 0 & c_{22}+c_{21} \end{bmatrix} \begin{bmatrix} X' \\ \theta' \\ x'_{12} \\ x'_{22} \end{bmatrix} + \begin{bmatrix} k_{12}+k_{22} & -k_{12}L_1+k_{22}L_2 & -k_{12} & -k_{22} \\ -k_{12}L_1+k_{22}L_2 & k_{12}L_1^2+k_{22}L_2^2 & k_{12}L_1 & -k_{22}L_2 \\ -k_{12} & k_{12}L_1 & k_{11}+k_{12} & 0 \\ -k_{22} & -k_{22}L_2 & 0 & k_{21}+k_{22} \end{bmatrix} \begin{bmatrix} X \\ \theta \\ x_{12} \\ x_{22} \end{bmatrix} = \begin{bmatrix} 0 \\ 0 \\ k_{11}x_{11}+c_{11}x'_{11} \\ k_{21}x_{21}+c_{21}x'_{12} \end{bmatrix} \quad (2)$$

Similarly to the inverse estimation using the model formula (1), the abnormality determination unit 33 puts the mass M, the inertia moment I, the measured acceleration X1", the calculated speed X', the calculated displacement amount X, the spring constants k11, k12, k21, and k22 in a normal case, the attenuation coefficients c11, c12, c21, and c22 in the normal case, and the like into the model formula (2), thereby performing inverse estimation for calculating a displacement amount in an up and down direction of the tire 12, a spring constant, and an attenuation coefficient by an optimization calculation when simultaneous equations are satisfied. When it is determined that there is abnormality in the track L, the abnormality determination unit 33 specifies and outputs the displacement amount x11 and x21 in the up and down direction of the tire 12 as a result of the inverse estimation. Furthermore, when it is determined that there is abnormality in a vehicle, the abnormality determination unit 33 specifies a tire corresponding to a spring constant and an attenuation coefficient which are values deviating from the spring constants or the attenuation coefficients in the normal case, and a constituent member such as a buffer device as abnormal places as a result of the inverse estimation.

Figure 7:
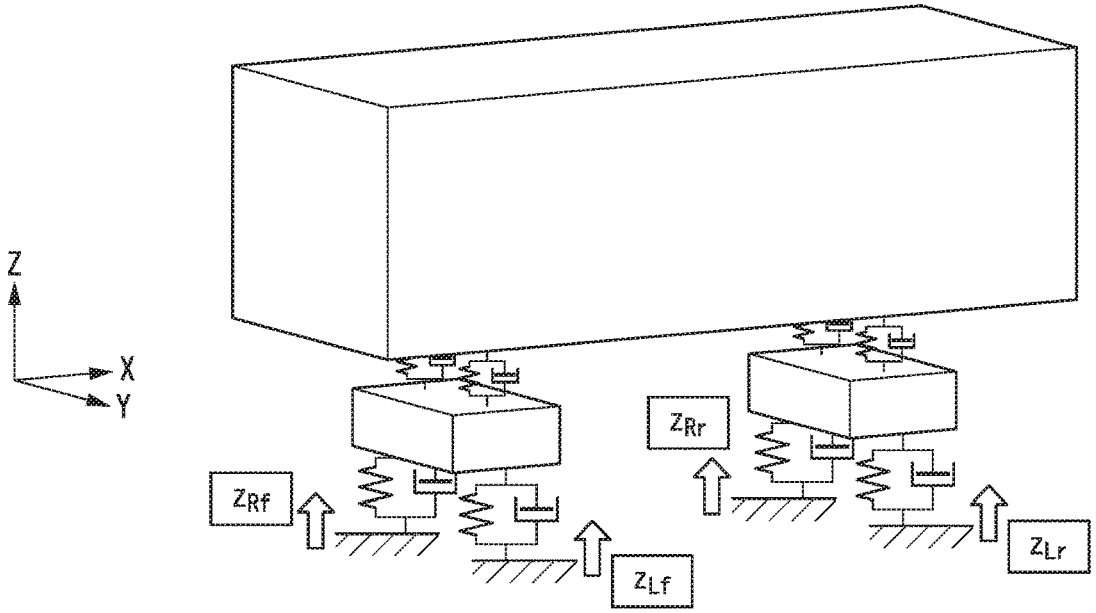
FIG. 7 is a first diagram showing a third example of the vehicle model.

FIG. 7 is a first diagram showing a third example of the vehicle model.

Figure 8:
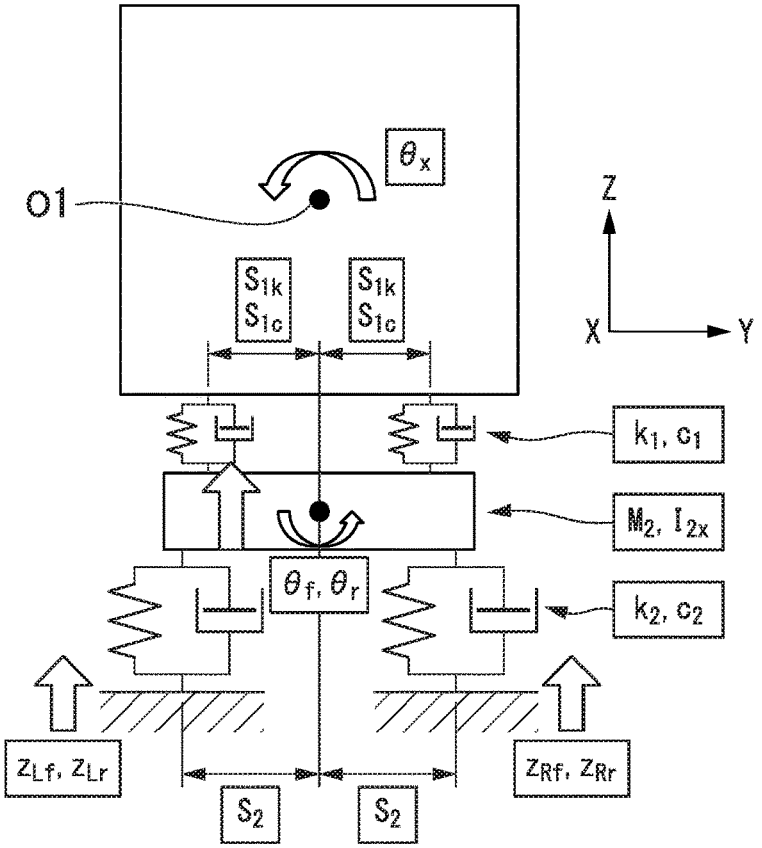
FIG. 8 is a second diagram showing the third example of the vehicle model.

FIG. 8 is a second diagram showing the third example of the vehicle model.

Figure 9:
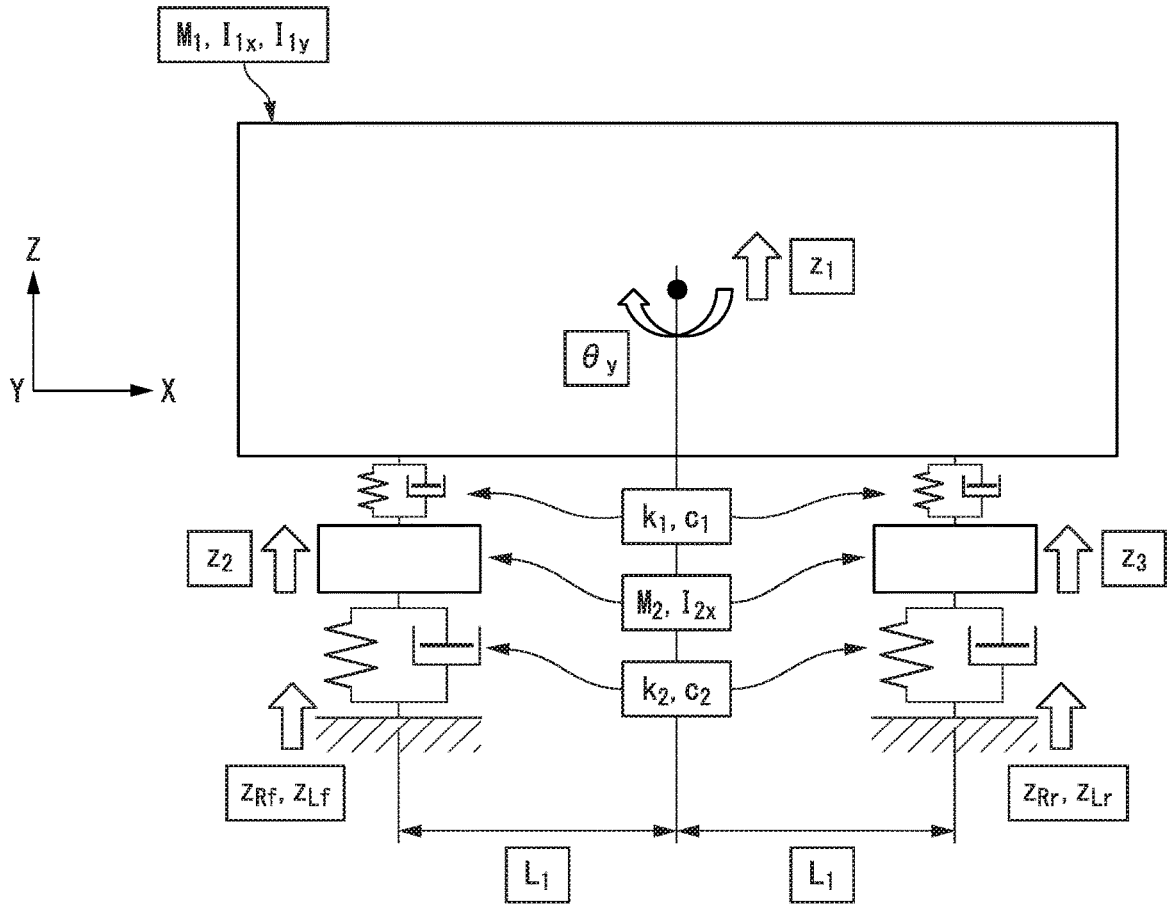
FIG. 9 is a third diagram showing the third example of the vehicle model.

FIG. 9 is a third diagram showing the third example of the vehicle model.

The abnormality determination unit 33 may use a model formula (3) below instead of the model formula (1) or the model formula (2). The explanations of model formulas shown in FIG. 7 to FIG. 9 are examples when force applied to the right and left tires 12 provided on the bogies 11 respectively provided at the front side and the rear side of the vehicle body 10 is expressed by separate model formulas.

FIG. 7 shows displacement amounts zRf, zLf, zRr, and zLr in an up and down direction of four tires 12 provided at the front, rear, left and right sides of the vehicle 3.

FIG. 8 shows the section of the vehicle 3 of a YZ plane in a spatial coordinate in which a rear direction from a front direction of the vehicle 3 is an X axis, a right and left direction of a vehicle body is a Y axis, and a vertical direction of the vehicle body is a Z axis.

As shown in FIG. 8, it is assumed that a vehicle body roll angle when a center position of a YZ plane of the vehicle body 10 is employed as a rotating axis is θx, a bogie roll angle when a center position of a YZ plane of a bogie 11 provided at a front side of the vehicle 3 is employed as a rotating axis is θf, and a bogie roll angle when a center position of a YZ plane of a bogie 11 provided at a rear side of the vehicle 3 is employed as a rotating axis is θr.

Furthermore, as shown in FIG. 8, it is assumed that a distance between a perpendicular line of the center position of the vehicle body 10 on the YZ plane and a perpendicular line of a position of an air spring in a left buffer device or a right buffer device of the vehicle body 10 is S1*k* and a distance between the perpendicular line of the center position of the vehicle body 10 and a perpendicular line of a position of a damper in the left buffer device or the right buffer device of the vehicle body 10 is S1*c*. Furthermore, it is assumed that a distance between the perpendicular line of the center position of the vehicle body 10 on the YZ plane and the perpendicular lines of the right and left tires 12 is S2.

Furthermore, it is assumed that the inertia moment of the bogie 11 is I2*x*.

FIG. 9 shows the section of the vehicle 3 on a XZ plane at spatial coordinates in which a rear direction from a front direction of the vehicle 3 is an X axis, a right and left direction of a vehicle body is a Y axis, and a vertical direction of the vehicle body is a Z axis. As shown in FIG. 9, it is assumed that a vehicle body pitch angle when the center position of the vehicle body 10 on the XZ plane is employing as a rotating axis is θy, a displacement amount in an up and down direction of the vehicle body 10 is Z1, the vertical displacement of the bogie 11 provided at the front side of the vehicle 3 is Z2, and the vertical displacement of the bogie 11 provided at the rear side of the vehicle 3 is Z3. Furthermore, it is assumed that the inertia moment in a roll direction of the vehicle body 10 is I1*x*, the inertia moment in a pitch direction of the vehicle body 10 is I1*y*, and a distance between a perpendicular line of the center position of the vehicle body 10 on the XZ plane and a perpendicular line of a tire in a front buffer device or a rear buffer device of the vehicle body 10 is L1. In such a case, the model formula can be expressed by a formula (3) below, wherein each vector of the model formula (3) can be expressed by formulas (4) to (8).

$$MX'' + CX' + KX = F \tag{3}$$

$$X = [z_1\ z_2\ z_3\ \theta_x\ \theta_y\ \theta_f\ \theta_r]^T \tag{4}$$

$$M = \begin{bmatrix} M_1 & 0 & 0 & 0 & 0 & 0 & 0 \\ 0 & M_2 & 0 & 0 & 0 & 0 & 0 \\ 0 & 0 & M_2 & 0 & 0 & 0 & 0 \\ 0 & 0 & 0 & I_{1x} & 0 & 0 & 0 \\ 0 & 0 & 0 & 0 & I_{1y} & 0 & 0 \\ 0 & 0 & 0 & 0 & 0 & I_2 & 0 \\ 0 & 0 & 0 & 0 & 0 & 0 & I_2 \end{bmatrix} \tag{5}$$

$$F = \begin{bmatrix} 0 \\ c_2(z'_{Rf} + z'_{Lf} + k_2(z_{Rf} + z_{Lf}) \\ c_2(z'_{Rr} + z'_{Lr}) + k_2(z_{Rr} + z_{Lr}) \\ 0 \\ 0 \\ c_2S_2(z'_{Rf} - z'_{Lf}) + k_2S_2(z_{Rf} - z_{Lf}) \\ c_2S_2(z'_{Rr} - z'_{Lr}) + k_2S_2(z_{Rf} - z_{Lr}) \end{bmatrix} \tag{6}$$

$$C = \begin{bmatrix} 4c_1 & -2c_1 & -2c_1 & 0 & 0 & 0 & 0 \\ -2c_1 & 2(c_1 + c_2) & 0 & 0 & -2cL & 0 & 0 \\ -2c_1 & 0 & 2(c_1 + c_2) & 0 & 2c_1L & 0 & 0 \\ 0 & 0 & 0 & 4c_1S_{1c}^2 & 0 & -2c_1S_{1c}^2 & -2c_1S_{1c}^2 \\ 0 & -2c_1L_1 & 2c_1L_1 & 0 & 4c_1L_1^2 & 0 & 0 \\ 0 & 0 & 0 & -2c_1S_{1c}^2 & 0 & 2c_1S_{1c}^2 + 2c_2S_{1c}S_2 - c_2S_2^2 & 0 \\ 0 & 0 & 0 & -2c_1S_{1c}^2 & 0 & 0 & 2c_1S_{1c}^2 + 2c_2S_{1c}S_2 - c_2S_2^2 \end{bmatrix} \tag{7}$$

$$K = \begin{bmatrix} 4k_1 & -2k_1 & -2k_1 & 0 & 0 & 0 & 0 \\ -2k_1 & 2(k_1 + k_2) & 0 & 0 & -2k_1L & 0 & 0 \\ -2k_1 & 0 & 2(k_1 + k_2) & 0 & 2k_1L & 0 & 0 \\ 0 & 0 & 0 & 4k_1S_{1k}^2 & 0 & -2k_1S_{1k}^2 & -2k_1S_{1k}^2 \\ 0 & -2k_1L_1 & 2k_1k_1 & 0 & 4k_1L_1^2 & 0 & 0 \\ 0 & 0 & 0 & -2k_1S_{1k}^2 & 0 & 2k_1S_{1k}^2 + 2k_2S_{1k}S_2 - k_2S_2^2 & 0 \\ 0 & 0 & 0 & -2k_1S_{1k}^2 & 0 & 0 & 2k_1S_{1k}^2 + 2k_2S_{1k}S_2 - k_2S_2^2 \end{bmatrix} \tag{8}$$

Similarly to the inverse estimation using the model formula (1) or (2), the abnormality determination unit 33 puts the masses M1 and M2, a measured acceleration, a calculated speed, the displacement amounts Z1 to Z3 calculated on the basis of a measurement value of the acceleration sensor 2*a*, the displacement amounts ZRf. ZRr, ZRf, and ZRr in a normal case, the inertial moments I1*x*, I1*y*, and I2*x*, the measured inclinations θx, θy, θf, and θr, the spring constants K1 and K2 in the normal case, the attenuation coefficients C1 and C2 in the normal case, and the like into the model formula (3), thereby performing inverse estimation for calculating a displacement amount in an up and down direction of the tire 12, a spring constant, and an attenuation coefficient by an optimization calculation when simultaneous equations are satisfied. When it is determined that there is abnormality in the track L, the abnormality determination unit 33 specifies and outputs the displacement amounts ZRf, ZRr, ZRf, and ZRr in the up and down direction of the tire 12 as a result of the inverse estimation. Furthermore, when it is determined that there is abnormality in the vehicle 3, the abnormality determination unit 33 specifies a tire corresponding to a spring constant and an attenuation coefficient which are values deviating from the spring constants or the attenuation coefficients in the normal case, and a constituent member such as a buffer device as abnormal places.

Since the aforementioned model formulas (1) to (3) are examples, the abnormality in a constituent member may be specified by performing inverse estimation using other model formulas. It is assumed that an object to be specified as being abnormal is the vehicle body 10, an air spring or a damper constituting the buffer device of the bogie 11, the tire 12 and the like in the aforementioned model formulas (1) to (3); however, other constituent members may be employed as the object to be specified as being abnormal.

Furthermore, in the aforementioned examples, a case where the acceleration of a train including a plurality of connected vehicles 3 is measured to perform processing has been described. However, the vehicles 3 may not be connected to one another, the plural of each individual vehicle 3 may be employed as a unit, and then the abnormality detection device 1 may determine whether the accelerations of one set of all vehicles 3 are equal to or more than a threshold value in step S105.

Furthermore, in the aforementioned processing flow, when the accelerations equal to or more than the threshold value are detected, the abnormal position of the track or the displacement amount of the tire 12 is specified, or an abnormal constituent member is specified by using the model formulas (1) to (3). However, even when the accelerations equal to or more than the threshold value are not detected, the abnormal position of the track or the displacement amount, or the abnormal constituent member may be specified at constant intervals by using these model formulas. Furthermore, this result is recorded in the database device 107, so that a change in a state may be determined, determination regarding whether the constituent member is deteriorating may be performed, or a deterioration period may be calculated on the basis of a change in a spring constant or an attenuation coefficient of the recorded constituent member.

According to such a process, it is possible to estimate the probability of the occurrence of abnormality in the constituent member before the abnormality occurs. Furthermore, since individual measurement of each constituent member is not necessary, it is possible to determine the state of each constituent member by using only a representative acceleration measurement result.

In the aforementioned process, accelerations acquired by the acceleration sensors 2 are used to perform the process; however, a displacement amount, a speed per unit time, and the like may be measured and converted into accelerations. Furthermore, accelerations may be replaced with displacement or speeds and inverse estimation of judgment, track unevenness, and a vehicle model may be performed using a threshold value.

Furthermore, the vehicle 3 may be provided with guide wheels which is in contact with right and left guide rails of the vehicle body 10, and abnormality in the guide rails or the guide wheels may be detected using a model formula of force transferred front the guide wheels to the guide rails. In such a case, a model formula in at least one point of the right and left sides of the vehicle body 10 is required. In addition, the number of measurement points of accelerations and the like increases, so that it is possible to improve the accuracy of abnormality determination. As a threshold value of the acceleration, in addition to a root mean square (rms) value, a maximum value, and a frequency analysis (⅓ octave band analysis) value, data may be accumulated for these parameters from an initial state and a Mahalanobis distance calculated by performing analysis using a MT method may be used as the threshold value.

Furthermore, when the aforementioned process is performed, at the time of construction (beginning) of the track L, unevenness amounts of the track (a road surface and a guide) may be measured and then a displacement amount obtained by adding a predetermined value to unevenness amounts at each position may be used as the threshold value. For installation places of the acceleration sensors 2 in the vehicle body 10, accelerations of other measurement places are estimated from one measurement point by using a Kalman filter and the like, so that measurement points may be reduced. In an optimization calculation using a model formula, for example, it is sufficient if inverse estimation is performed such that values such as each spring constant and attenuation coefficient indicating a state amount of a constituent member, a variation amount in an up and down direction, and the like are minimized using a squared sum of errors of each tick time between measured accelerations and accelerations calculated from an analysis model is employed as an objective function.

The aforementioned abnormality detection device 1 has a computer system therein. Furthermore, the aforementioned each processing step is stored in a computer readable recording medium in the form of a program and the program is read and executed by the computer, so that the process is performed. Examples of the computer readable recording medium include a magnetic disk, a magneto-optical disk, a CD-ROM, a DVD-ROM, a semiconductor memory and the like. Furthermore, the computer program may be distributed to the computer by a communication line and the computer having received the distribution may execute the program.

Furthermore, the aforementioned program may be a program for performing some of the aforementioned functions.

Moreover, the aforementioned program may be a program capable of performing the aforementioned functions through a combination with a program already recorded in the computer system, so-called a differential filter (a differential program).

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An abnormality detection device configured to detect an abnormality occurring when a plurality of vehicles each equipped with an acceleration sensor and a constituent member is running along a track, the abnormality detection device comprising:

a processor and a memory, the processor executing instructions stored on the memory to implement:

a measurement value acquiring unit configured to acquire input accelerations with respect to the plurality of vehicles; and an abnormality determination unit configured to determine the abnormality at a track position upon detecting the input accelerations above a threshold value with respect to all the plurality of vehicles so as to output information representing the track position having the abnormality, the abnormality determination unit being configured to determine the abnormality in a vehicle having the input acceleration above the threshold value upon detecting the input acceleration above the threshold value with respect to at least one vehicle among the plurality of vehicles so as to output information identifying the vehicle having the abnormality.

2. The abnormality detection device according to claim 1, wherein the measurement value acquiring unit is configured to acquire a correspondence relation between the input acceleration and a position of the track, and the abnormality determination unit is configured to inversely estimate a vertical displacement amount of the track based on the input accelerations according to a model formula assigning a mass and acceleration relating to the vehicle as well as a state amount of the constituent member of the vehicle and to specify the vertical displacement amount deviated from its normal value and a position of the track causing the vertical displacement amount when the abnormality determination unit detects the input accelerations above the threshold value with respect to all the plurality of vehicles, thus outputting the vertical displacement amount of the track and the information of the track position.

3. The abnormality detection device according to claim 1, wherein the measurement value acquiring unit is configured to acquire a correspondence relation between the input acceleration and a position of the track, and the abnormality determination unit is configured to inversely estimate a state amount of the constituent member of the vehicle based on the input accelerations according to a model formula assigning a mass and acceleration relating to the vehicle as well as a state amount of the constituent member of the vehicle and to specify, as an abnormal place, the constituent member which indicates the state amount deviated from its normal value when the abnormality determination unit detects the input accelerations above the threshold value with respect to the at least one vehicle among the plurality of vehicles, thus outputting information identifying the constituent member.

4. The abnormality detection device according to claim 1, wherein the abnormality determination unit is configured to inversely estimate a state amount of a constituent member of the vehicle based on the input accelerations according to a model formula assigning a mass and acceleration relating to the vehicle as well as a state amount of the constituent member of the vehicle and to specify, as an abnormal place, the constituent member which indicates the state amount deviated from its normal value when the abnormality determination unit fails to detect the input accelerations above the threshold value with respect to the plurality of vehicles thus outputting information identifying the constituent member.

5. The abnormality detection device according to claim 1, wherein the vehicle includes a vehicle body and a bogie, wherein the mass and the acceleration of the vehicle includes a mass and acceleration of the vehicle body and a mass and acceleration of the bogie, wherein the constituent member is interposed between the vehicle body and the bogie or between the bogie and the track, and wherein the state amount of the constituent member represents a spring constant and an attenuation coefficient.

6. An abnormality detection method configured to detect an abnormality occurring when a plurality of vehicles each equipped with an acceleration sensor and a constituent member is running along a track, the abnormality detection method comprising:

acquiring input accelerations with respect to the plurality of vehicles;

determining the abnormality at a track position upon detecting the input accelerations above a threshold value with respect to all the plurality of vehicles so as to output information representing the track position having the abnormality; and determining the abnormality in a vehicle having the input acceleration above the threshold value upon detecting acceleration above the threshold value with respect to at least one vehicle among plurality of vehicles so as to output information identifying the vehicle having the abnormality.

7. The abnormality detection method according to claim 6, wherein the vehicle includes a vehicle body and a bogie, wherein the mass and the acceleration of the vehicle includes a mass and acceleration of the vehicle body and a mass and acceleration of the bogie, wherein the constituent member is interposed between the vehicle body and the bogie or between the bogie and the track, and wherein the state amount of the constituent member represents a spring constant and an attenuation coefficient.

8. A non-transitory computer-readable recording medium storing a program installed in an abnormality detection device configured to detect an abnormality occurring when a plurality of vehicles each equipped with an acceleration sensor and a constituent member is running along a track, comprising acquiring input accelerations with respect to the plurality of vehicles; and determining the abnormality at a track position upon detecting the input accelerations above a threshold value with respect to all the plurality of vehicles so as to output information representing the track position having the abnormality, while determining the abnormality in a vehicle having the input acceleration above the threshold value upon detecting acceleration above the threshold value with respect to at least one vehicle among the plurality of vehicles so as to output information identifying the vehicle having the abnormality.

* * * * *